US010103486B1

(12) United States Patent
Yan et al.

(10) Patent No.: US 10,103,486 B1
(45) Date of Patent: Oct. 16, 2018

(54) POWER ADAPTER

(71) Applicant: AMPHENOL FIBER OPTIC TECHNOLOGY (SHENZHEN) CO., LTD., Shenzhen (CN)

(72) Inventors: Junbei Yan, Shenzhen (CN); David Frey, Shenzhen (CN); Songsheng Li, Shenzhen (CN)

(73) Assignee: AMPHENOL FIBER OPTIC TECHNOLOGY (SHENZHEN) CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/811,070

(22) Filed: Nov. 13, 2017

(30) Foreign Application Priority Data

Jul. 28, 2017 (TW) ..... 106211129 U

(51) Int. Cl.
*H01R 13/58* (2006.01)
*H01R 13/635* (2006.01)
*H01R 31/06* (2006.01)

(52) U.S. Cl.
CPC ..... *H01R 13/635* (2013.01); *H01R 13/5812* (2013.01); *H01R 31/06* (2013.01)

(58) Field of Classification Search
CPC ... H01R 13/5812; H01R 13/635; H01R 31/06
USPC ..... 439/447, 594, 654, 701, 717, 731, 722
See application file for complete search history.

(56) References Cited

U.S. PATENT DOCUMENTS 6,508,671 B2 * 1/2003 Ko ..... H01R 13/506 439/447
6,893,298 B2 * 5/2005 Scarpellini ..... H01R 9/2658 439/701
6,902,441 B2 * 6/2005 Sablatzky ..... H01R 29/00 439/518
7,401,946 B2 * 7/2008 Laukhuf ..... F21S 4/28 362/219
7,789,718 B2 * 9/2010 Desard ..... H01R 4/36 439/276
8,764,308 B2 * 7/2014 Irwin ..... G02B 6/3879 385/134
8,876,403 B2 * 11/2014 Katoh ..... G02B 6/3831 385/55
8,894,448 B2 * 11/2014 Affeltranger ..... H01R 4/2433 439/701
9,431,760 B2 * 8/2016 Itou ..... H01R 13/6271
9,448,370 B2 * 9/2016 Xue ..... G02B 6/38
(Continued)

*Primary Examiner* — Amy Cohen Johnson
*Assistant Examiner* — Oscar Jimenez
(74) *Attorney, Agent, or Firm* — Muncy, Geissler, Olds & Lowe, P.C.

(57) ABSTRACT

A power adapter includes a connecting unit having a base plate, and first and second bodies cooperatively clamping therebetween the base plate. The first body includes a first main plate having a first opening, a first sleeve member defining a first space configured to receive a plug connector of a connector mechanism, a first connecting member provided on one side of the first main plate, and a second connecting member provided on the other side of the first main plate. The second body includes a second main plate having a second opening, and a second sleeve member defining a second space and configured to receive a plug connector of another connector mechanism. The connecting unit further has a connection module extending through the base plate.

11 Claims, 13 Drawing Sheets

(56) References Cited

U.S. PATENT DOCUMENTS

| | | | | |
|---|---|---|---|---|
| 2003/0194914 | A1* | 10/2003 | Duck | G02B 6/381<br>439/701 |
| 2004/0171312 | A1* | 9/2004 | Sichner | H01R 13/514<br>439/701 |
| 2011/0183550 | A1* | 7/2011 | Ohki | H01R 13/5216<br>439/701 |
| 2012/0052748 | A1* | 3/2012 | Sato | H05K 7/026<br>439/701 |
| 2018/0077323 | A1* | 3/2018 | Sakamoto | H04N 5/2253 |

* cited by examiner

POWER ADAPTER

CROSS-REFERENCE TO RELATED APPLICATION

This application claims priority of Taiwanese Patent Application No. 106211129, filed on Jul. 28, 2017.

FIELD

The disclosure relates to an adapter, more particularly to a power adapter.

BACKGROUND

Referring to FIG. 1, an existing power adapter 11 cooperates with a connector unit 12 for power wiring of an optical signal conversion device. The power adapter 11 includes a base plate 111, and a sleeve member 112 fixed to the base plate 11 and defining a space 100. The connector unit 12 is detachably inserted into the space 100, and is configured for extension of a power cable (not shown) therethrough.

Currently, in the field of communications, the amount of data transmitted is growing, so that the related signal conversion processing devices must be densely configured. In order to provide sufficient power to the aforesaid densely configured devices, the different components and the overall configuration of the lines used by the power supply configuration are also relatively huge. Thus, when a plurality of the power adapters 11 and the connector units 12 are used to configure the required power, apart from complicated wiring leading to confusion, if the power adapters 11 and the respective connector units 12 are scattered and are difficult to integrate with each other, the wiring work is also complicated. Further, since there is no foolproof design between the sleeve member 112 and the connector unit 12, apart from easily connecting in a wrong direction and must try many times, the efficiency of assembly is reduced. Moreover, if there is error in mating lines and is not immediately detected, when the power is turn on, it may cause a serious situation, such as a fire disaster due to burning of electrical wires.

SUMMARY

Therefore, an object of the present disclosure is to provide a power adapter that can alleviate at least one of the drawbacks of the prior art.

According to the disclosure, a power adapter is configured to cooperate with two connector mechanisms and two power cables. Each connector mechanism includes a tubular body for extension of a respective one of the power cables therethrough, and a plug connector connected to one end of the tubular body. The power adapter comprises a first body, a connecting unit and a second body. The first body includes a first main plate having two opposite first sides and a first opening between the first sides, a first sleeve member extending from a peripheral edge of the first opening in a direction away from the first main plate and defining a first space that is configured to receive the plug connector of one of the connector mechanisms, a first connecting member provided on one of the first sides of the first main plate, and a second connecting member provided on the other one of the first sides of the first main plate. The connecting unit includes a base plate abutting against the first main plate opposite to the first sleeve member.

The second body is connected to and cooperates with the first body to clamp the base plate therebetween. The second body includes a second main plate having a second opening, and a second sleeve member extending from a peripheral edge of the second opening in a direction away from the second main plate and defining a second space that is configured to receive the plug connector of another one of the connector mechanisms.

The connecting unit further includes a connection module extending through the base plate such that one end of the connection module extends into the first space through the first opening for electrical connection with one of the power cables extending through the tubular body of the one of the connector mechanisms, and the other end of the connection module extends into the second space through the second opening for electrical connection with another one of the power cables extending through the tubular body of the another one of the connector mechanisms.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
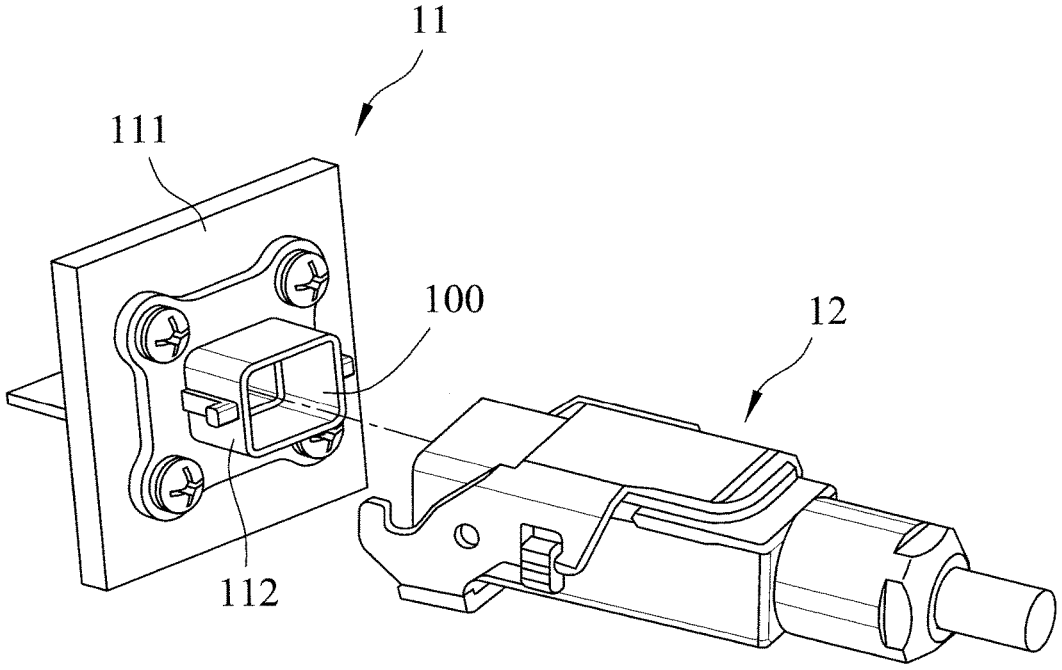
FIG.1 PRIOR ART
FIG. 1 illustrates how an existing power adapter cooperates with a connector unit.
Figure 2:
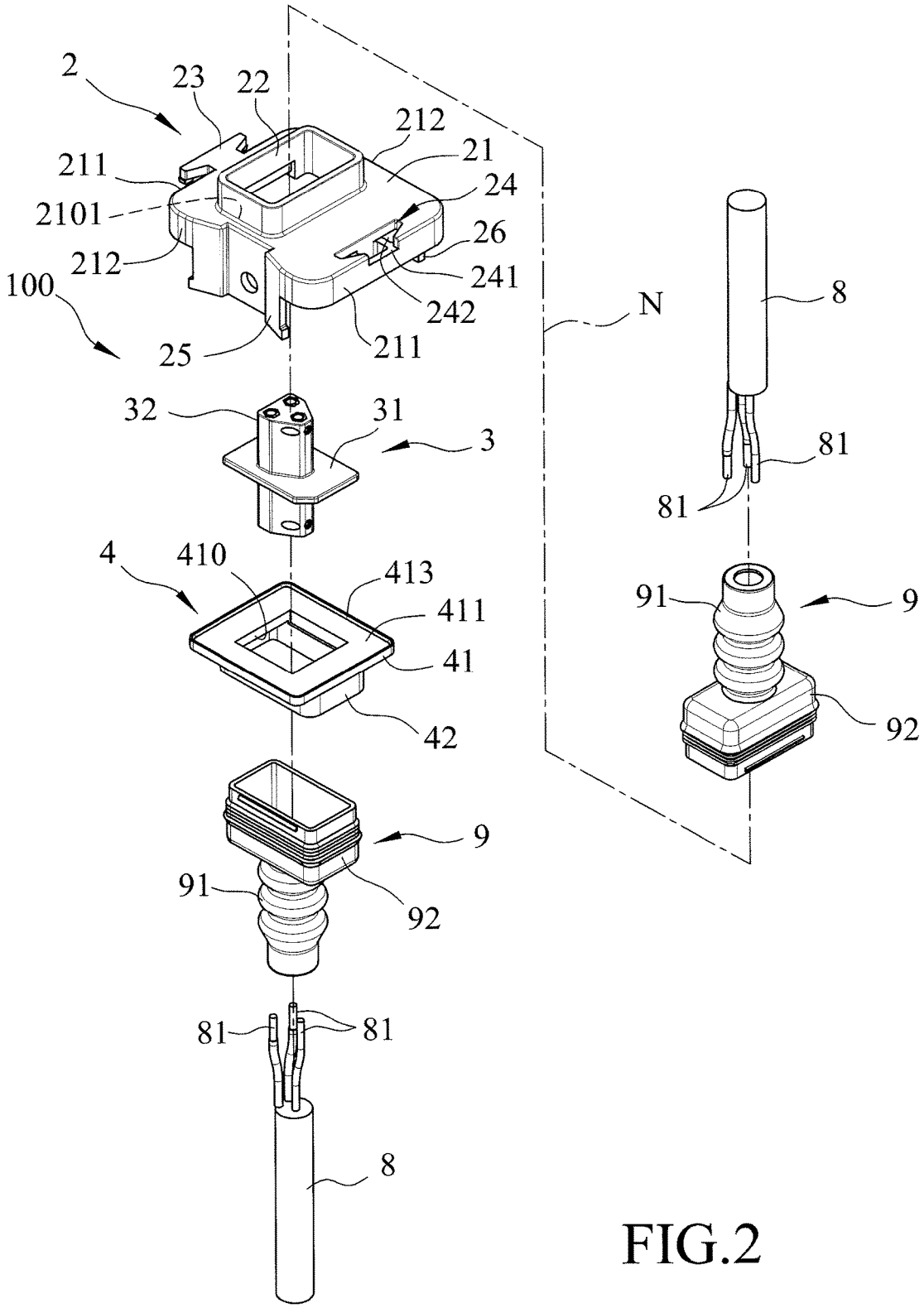
FIG. 2 is a partly exploded perspective view of a power adapter according to the embodiment of the present disclosure, illustrating how the power adapter of the embodiment cooperates with two connector mechanisms and two power cables.
Figure 3:
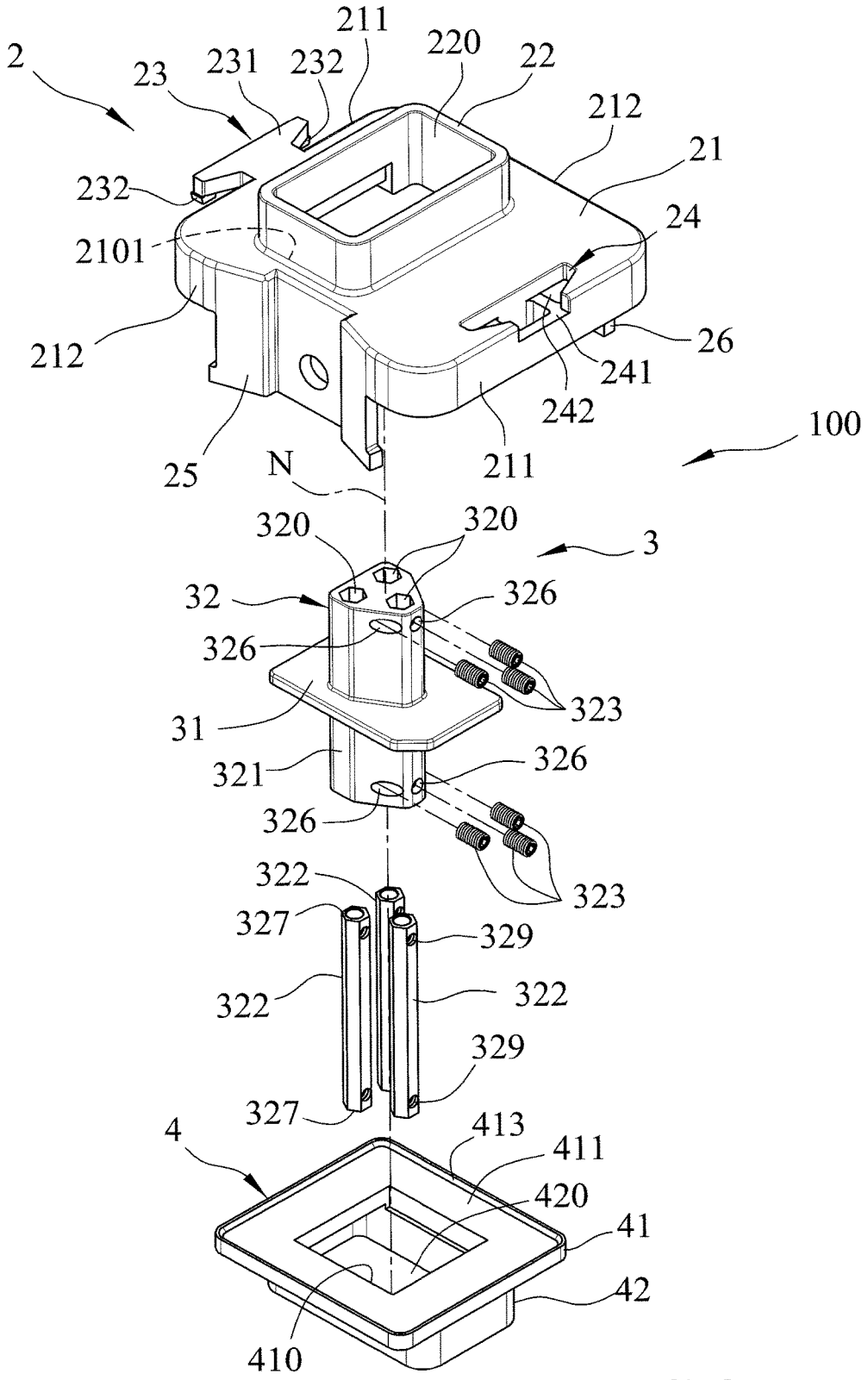
FIG. 3 is an exploded perspective view of the embodiment.
Figure 4:
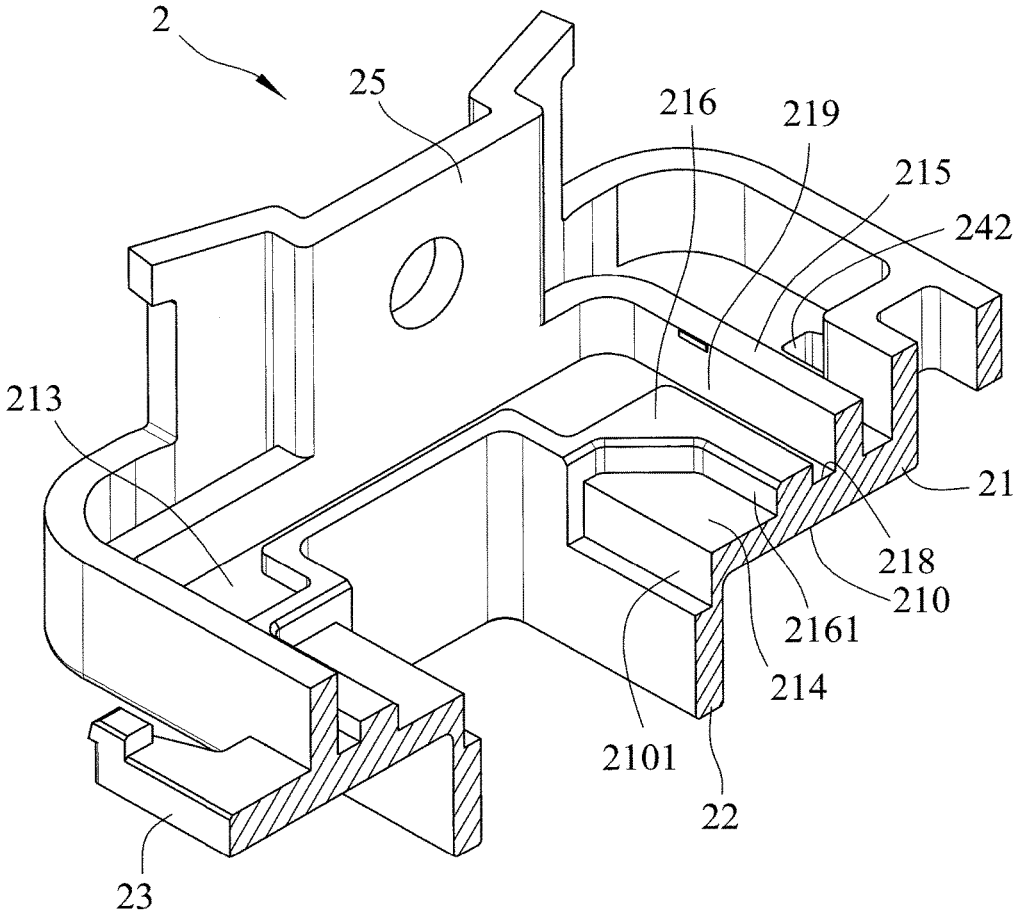
FIG. 4 is a sectional perspective view of a first body of the embodiment taken at an angle different from that shown in FIG. 3.

Referring to FIGS. 2 to 4, a power adapter 100 according to the embodiment of the present disclosure is configured to cooperate with two connector mechanisms 9 and two power cables 8. Each connector mechanism 9 includes a tubular body 91 for extension of a respective one of the power cables 8 therethrough, and a plug connector 92 connected to one end of the tubular body 91. The power cable 8 exemplified in this embodiment includes three power lines 81.

The power adapter 100 of this embodiment includes a first body 2, a connecting unit 3 and a second body 4.

The first body 2 includes a first main plate 21, a first sleeve member 22, a first connecting member 23, a second connecting member 24, a first identification member 25 and a second identification member 26. The first main plate 21 has a top surface 210, a bottom surface 213, two opposite first sides 211 interconnecting the top and bottom surfaces 210, 213, two opposite second sides 212 interconnecting the top and bottom surfaces 210, 213 and the first sides 211, a first opening 2101 extending through the top and bottom surfaces 210, 213, two receiving grooves 214 extending inwardly from the bottom surface 213 and located at two opposite sides of the first opening 2101, a first annular protrusion 215 protruding outwardly from the bottom surface 213 and defining a retaining space 219, and a second annular protrusion 216 protruding from the bottom surface 213 into the retaining space 219. The receiving grooves 214 are not symmetrical in shape (see FIG. 4), that is, one of the receiving grooves 214 has a substantially rectangular shape, while the other receiving groove 214 has a substantially trapezoidal shape. The first annular protrusion 215 cooperates with the second annular protrusion 216 to define an adhesive-receiving space 218 therebetween that communicates with the retaining space 219. The first annular protrusion 215 has a length measured from the bottom surface 213 greater than that of the second annular protrusion 216. The second annular protrusion 216 surrounds the receiving grooves 214, and defines a receiving space 2161 communicating with the receiving grooves 214.

The first sleeve member 22 extends from a peripheral edge of the first opening 2101 in a direction away from the first main plate 21, and defines a first space 220 configured to receive the plug connector 92 of one of the connector mechanisms 9.

The first connecting member 23 is provided on one of the first sides 211 of the first main plate 21, and includes a main portion 231 protruding outwardly from the one of the first sides 211 and having a substantially dovetail shape, and two hook portions 232 protruding transversely and respectively from two opposite sides of the main portion 231.

The second connecting member 24 includes a receiving recess 241 extending from the top surface 210 through the other one of the first sides 211 of the first main plate 21 and having a shape matching that of the main portion 231 of the first connecting member 23, and two spaced-apart engaging holes 242 formed in the bottom surface 213 in proximity to the other one of the first sides 211 and communicating with the receiving recess 241.

The first identification member 25 is connected to one of the second sides 212, while the second identification member 26 is connected to the other one of the second sides 212 and has a shape different from that of the first identification member 25. In this embodiment, the first identification member 25 has a substantially U-shaped cross section, whereas the second identification member 26 has a planar plate body. Through the different configurations of the first and second identification members 25, 26, a user can clearly identify the direction of the embodiment.

Figure 5:
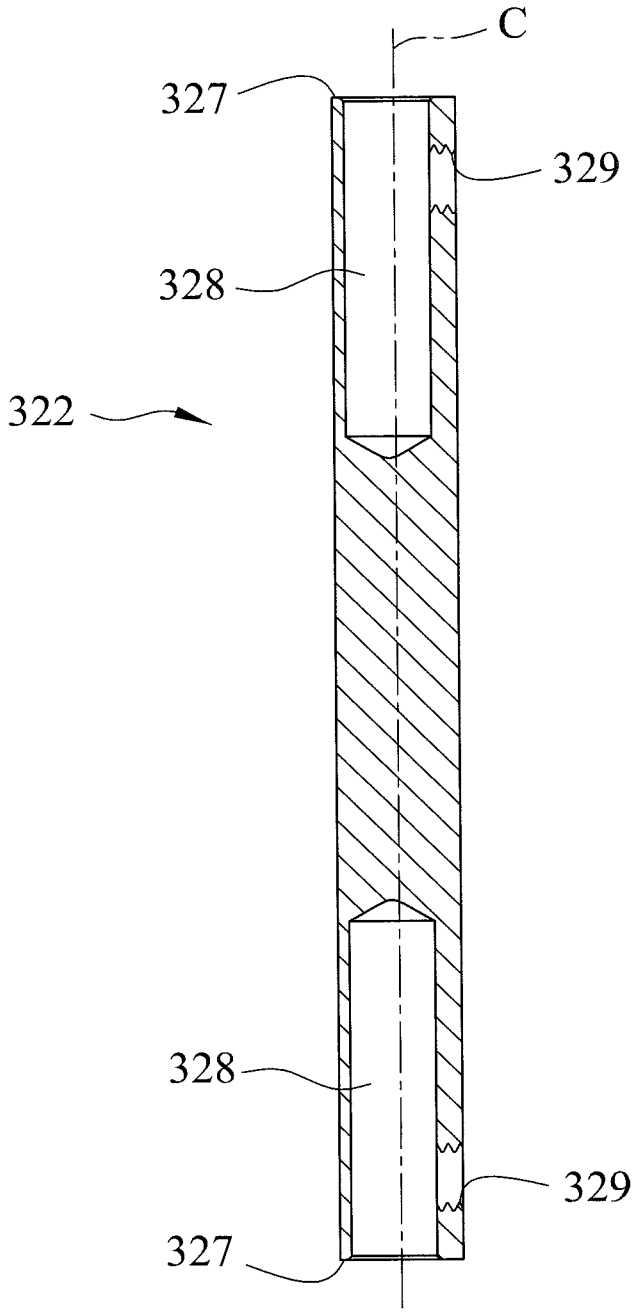
FIG. 5 is a sectional view of a conductive member of a connecting unit of the embodiment.
Figure 6:
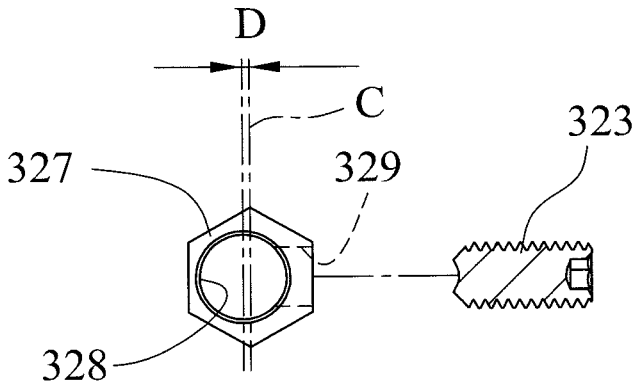
FIG. 6 is a schematic top view, illustrating how a conductive member and a screw of the connecting unit cooperate with each other.

Referring to FIGS. 5 and 6, in combination with FIG. 3, the connecting unit 3 includes a base plate 31 and a connection module 32. The base plate 31 has a rectangular shape with a cut corner. The connection module 32 includes a support column 321, three conductive members 322, and six screws 323. The support column 321 extends along a longitudinal direction (N), and extends through the base plate 31 such that two opposite ends thereof are disposed on two opposite sides of the base plate 21. The support column 321 has three spaced-apart insertion slots 320 extending along a length thereof. The conductive members 322 are respectively inserted into the insertion slots 320 for electrical conduction with the power cables 8. Each conductive member 322 extends along the longitudinal direction (N), and has a hexagonal cross section, so that when it is inserted into the respective insertion slot 320, it will not rotate relative to the support column 321. Each conductive member 322 has a longitudinal axis (C) parallel to the longitudinal direction (N), two end faces 327 opposite to each other along a length thereof, two blind holes 328 each extending inwardly a distance from a respective one of the end faces 327, and two threaded side holes 329 extending inwardly and radially from one of six sides thereof and respectively communicating with the blind holes 328. Each blind hole 328 is eccentric, and is radially offset from the longitudinal axis (C) by a distance (D). The threaded side holes 329 are respectively proximate to the end faces 327.

The support column 321 further has six through holes 326 formed in one side thereof. Three of the through holes 326 are spaced apart from the other three through holes 326 along the length thereof and are respectively aligned therewith. Each two of the aligned through holes 326 extend inwardly and radially from an outer surface of the one side of the support column 321, and communicate with a corresponding one of the insertion slots 320. When each conductive member 322 is inserted into the respective insertion slot 320, each two of the aligned through holes 326 respectively communicate with the blind holes 328 of a corresponding one of the conductive members 322 through the threaded side holes 329 thereof.

Each screw 323 is inserted into a respective one of the through holes 326, threadedly engages one of the threaded side holes 329 in one of the conductive members 322, and extends diametrically into a corresponding one of the blind holes 328 in the one of the conductive members 322. Through this, each conductive member 322 can be positioned in the respective insertion slots 320.

The second body 4 includes a second main plate 41 and a second sleeve member 42. The second main plate 41 has opposite top and bottom surfaces 411, 412, and a second opening 410 extending through the top and bottom surfaces 411, 412. The second sleeve member 42 extends from a peripheral edge of the second opening 410 in a direction away from the second main plate 41, and defines a second space 420 configured to receive the plug connector 92 of another one of the connector mechanisms 9. The second main plate 41 further has an annular flange 413 extending transversely from a periphery of the top surface 411 into the adhesive-receiving space 218.

Figure 7:
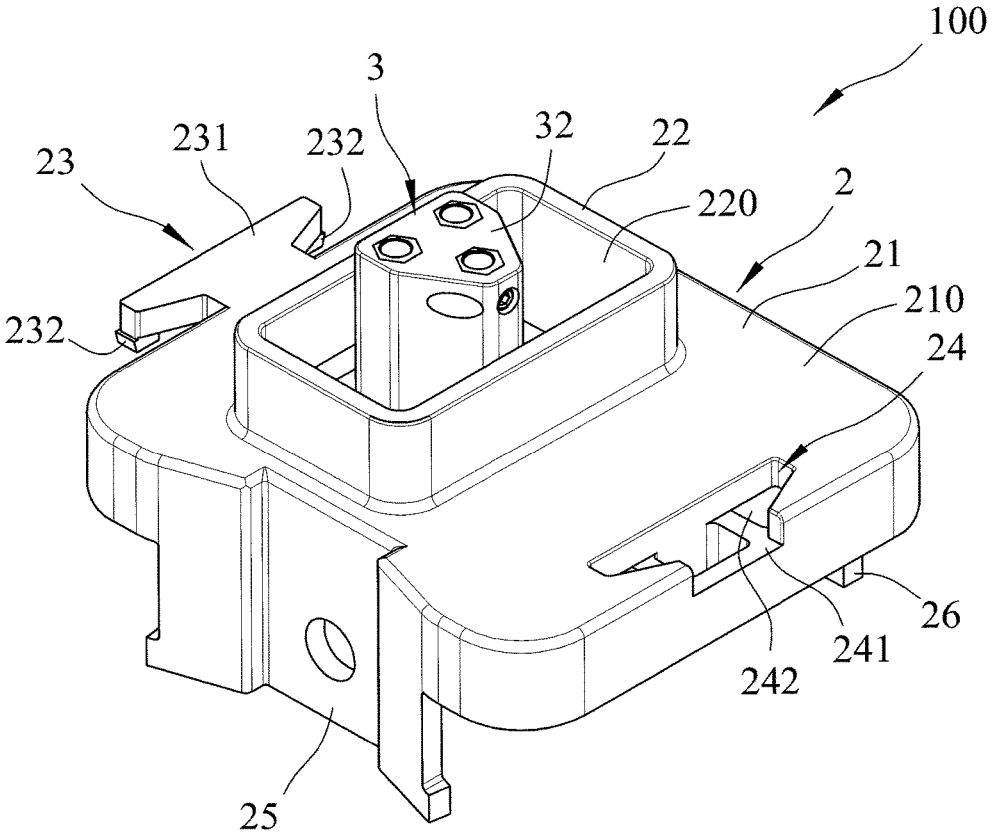
FIG. 7 is an assembled perspective view of the embodiment.
Figure 8:
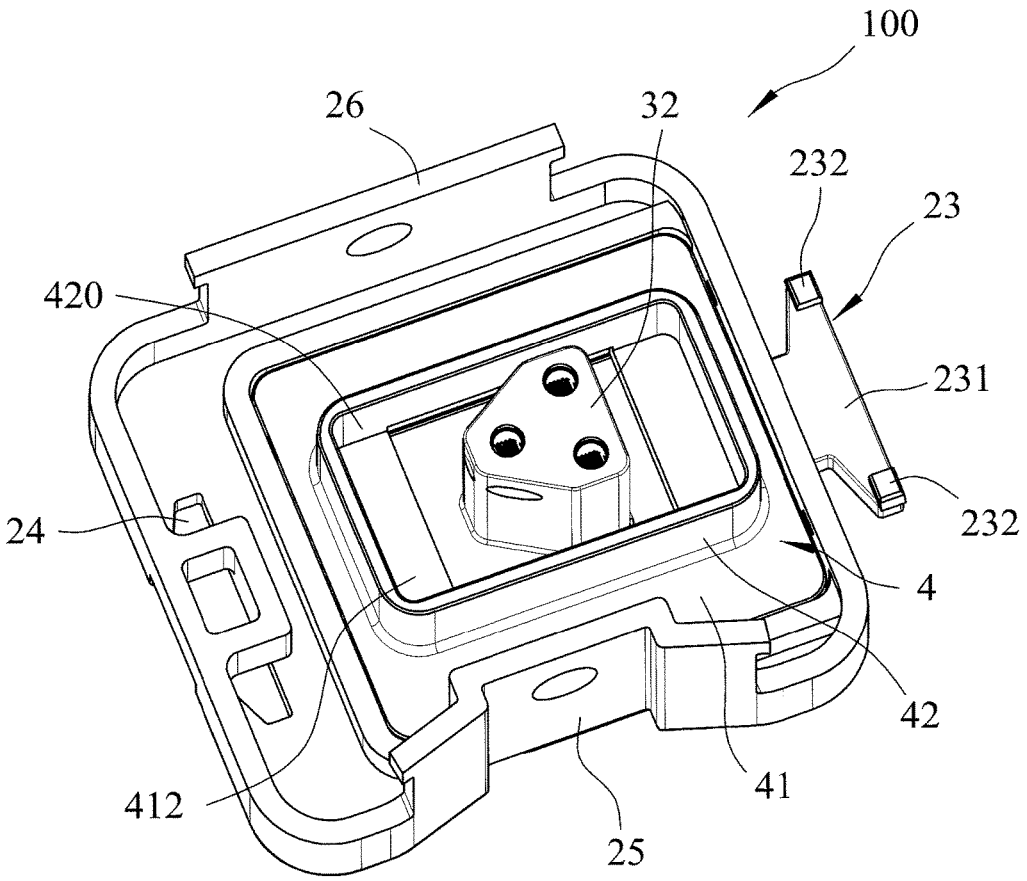
FIG. 8 is an assembled perspective view of the embodiment taken from another angle.
Figure 9:
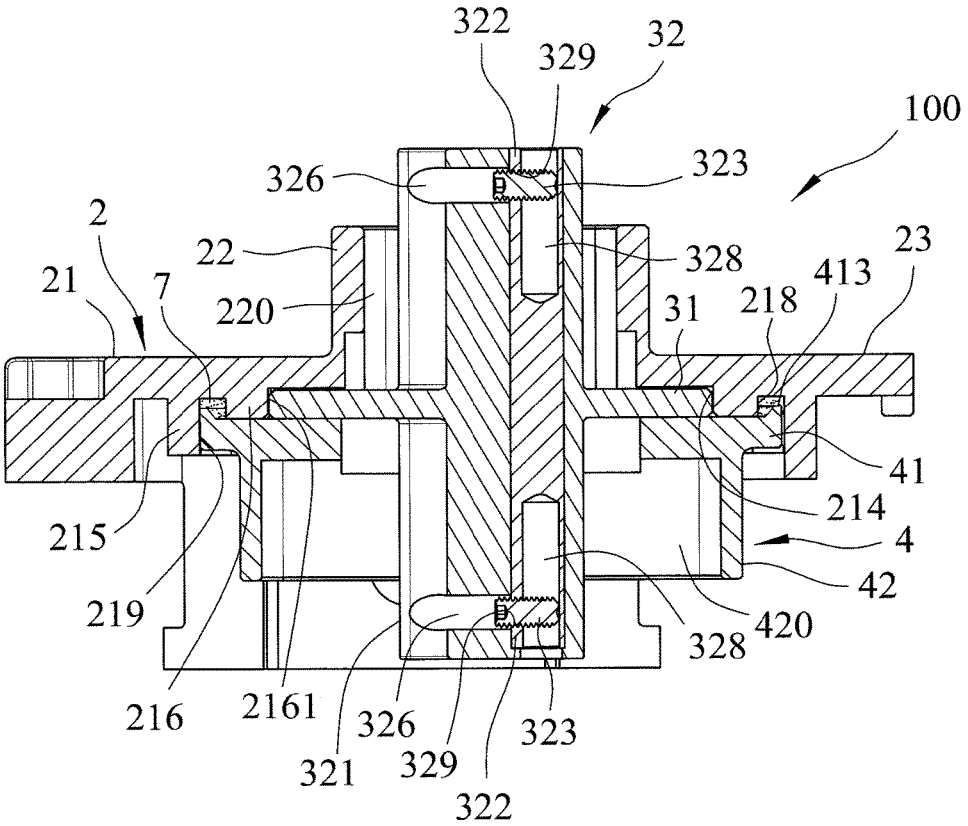
FIG. 9 is an assembled sectional view of the embodiment.

Referring to FIGS. 7 to 9, to assemble the power adapter 100, the base plate 31 is first positioned in the receiving space 2161 of the second annular protrusion 216 and the receiving grooves 214. At this time, one of the two opposite ends of the support column 321 extends into the first space 220 through the first opening 2101. Next, adhesive 7 is introduced into the adhesive-receiving space 218, and the second main plate 41 is disposed in the retaining space 219 such that the second main plate 41 abuts against the second annular protrusion 216 and the base plate 31 and the annular flange 413 thereof extends into the adhesive-receiving space 218. Since the adhesive-receiving space 218 and the retaining space 219 communicate with each other, in coordination with the annular flange 413 which extends into the adhesive-receiving space 218, the adhesive 7 can indeed fix the second body 4 to the bottom surface 213 of the first main plate 21, and can enhance the coupling strength between the first body 2 and the second body 4. Furthermore, the second main plate 41 can cooperate with the first main plate 21 to clamp the connecting unit 3 therebetween. At this time, the other end of the support column 321 extends into the second space 420 through the second opening 410. Hence, the assembly of this embodiment is completed.

It is worth to mention herein that since the receiving grooves 214 are not symmetrical, when the base plate 31 is correctly positioned in the receiving grooves 214, the two opposite ends of the support column 321 are also disposed in the correct directions. Through this, a foolproof effect can be achieved to ensure accuracy of the assembly.

Figure 10:
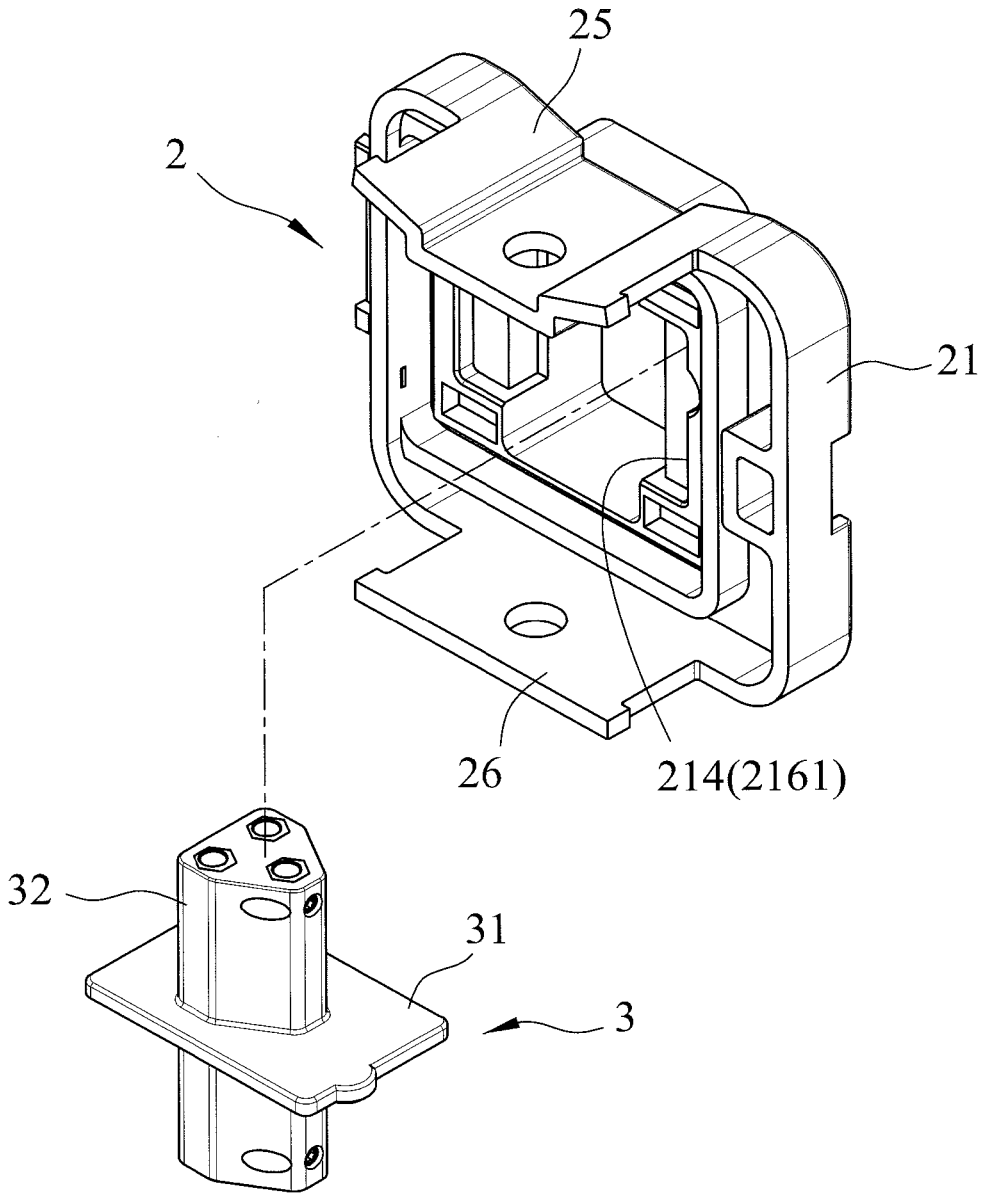
FIG. 10 illustrates an alternative form of a base plate of the connecting unit of the embodiment.

FIG. 10 illustrates an alternative form of the embodiment. In this case, the base plate 31 of the connecting unit 3 does not have a cut corner, but has a projection projecting outwardly from one side thereof, and the receiving grooves 214 of the first main plate 21 of the first body 2 are designed to conform with that of the base plate 31. Similarly, by using the asymmetrical structures of the base plate 31 and the receiving grooves 214, a foolproof effect can be achieved to ensure accuracy of the assembly.

Figure 11:
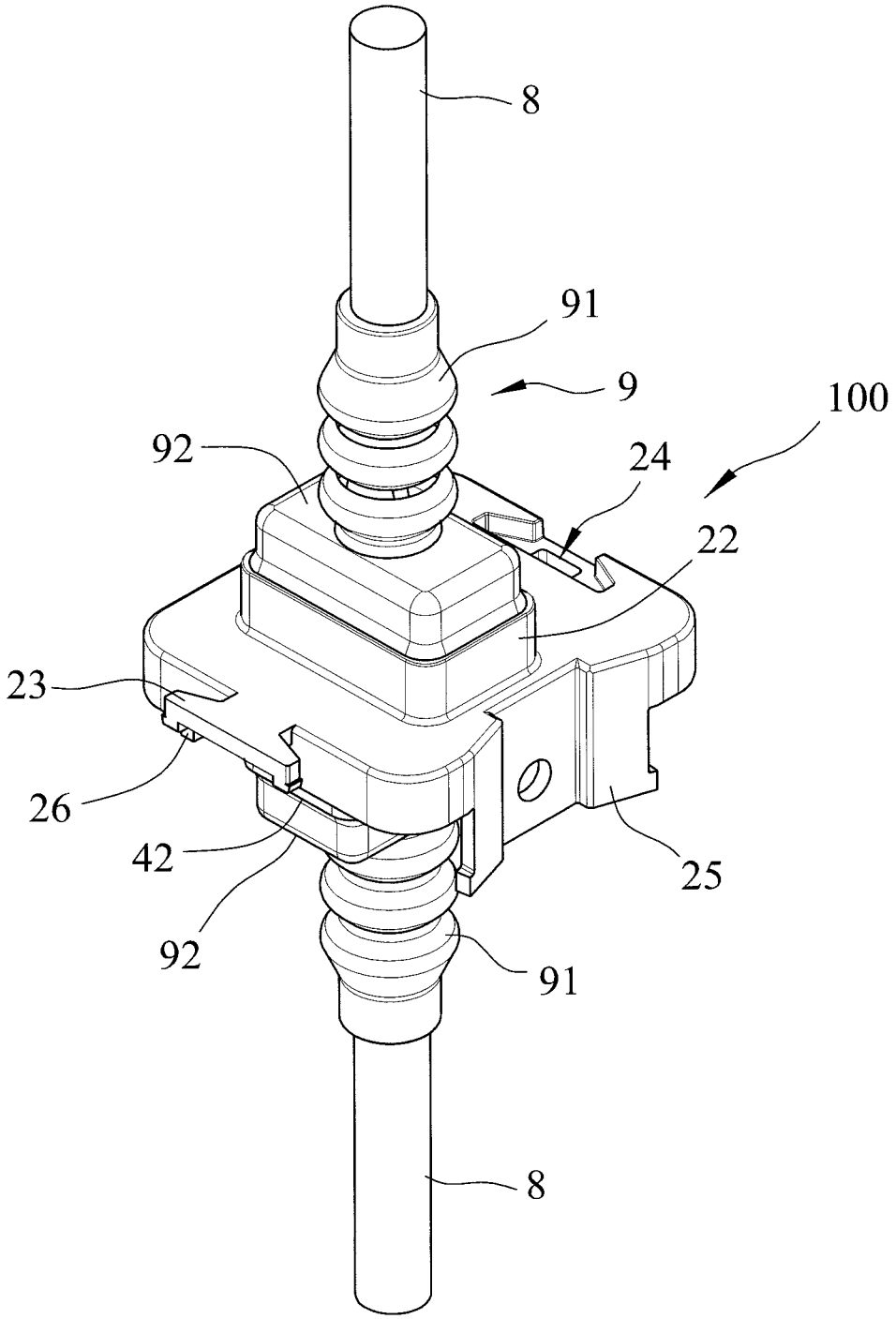
FIG. 11 illustrates the embodiment in a state of use.
Figure 12:
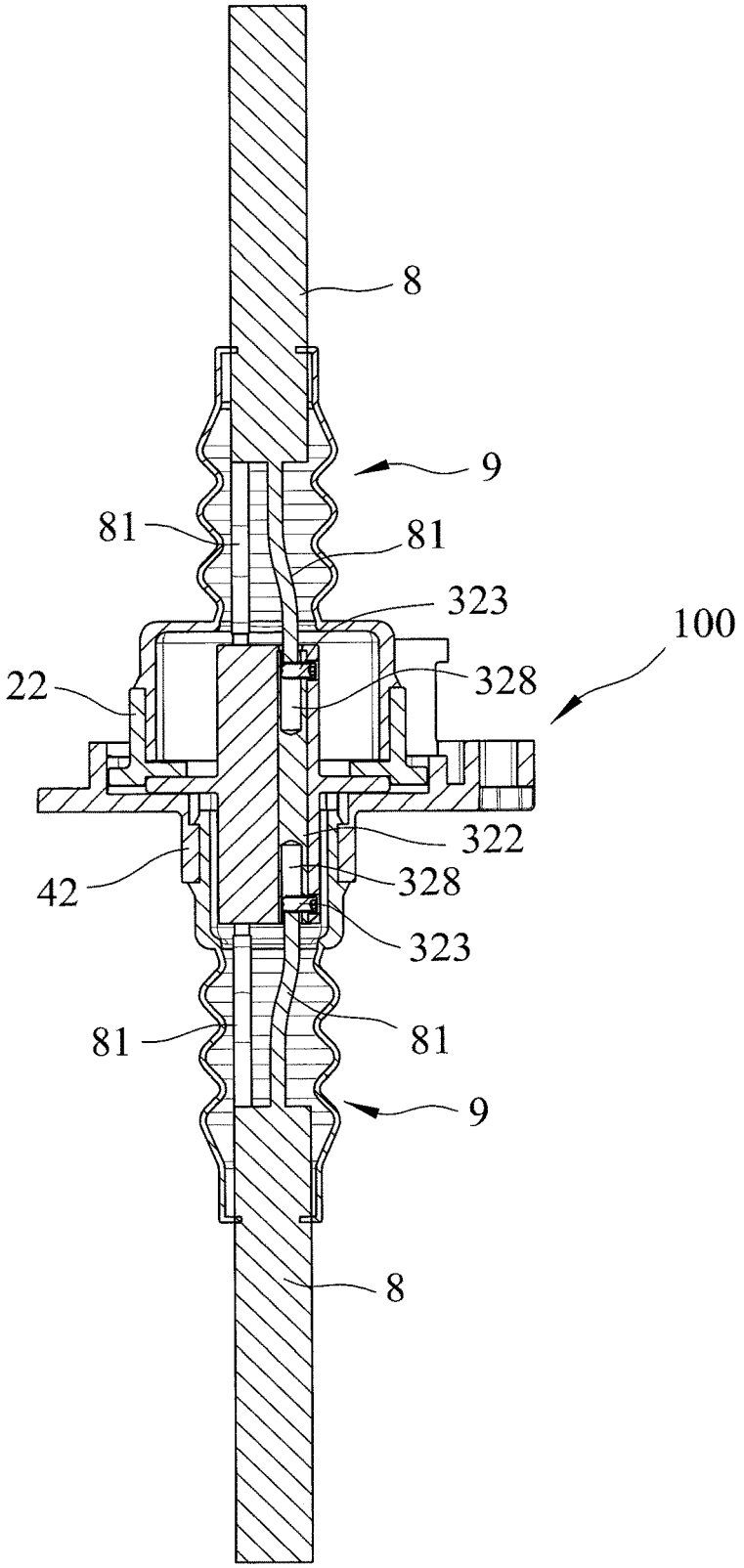
FIG. 12 is a sectional view of FIG. 11, illustrating how the power cables are electrically connected through the connecting unit of the embodiment.

Referring to FIGS. 11 and 12, in combination with FIG. 2, since the connector mechanisms 9 will be connected to the power cables 8 of different devices, the connector mechanisms 9 are still different from each other and must be connected correctly and respectively to the first and second sleeve members 22, 42. To match the shape of each plug connector 92 of the connector mechanisms 9, each of the first and second sleeve members 22, 42 has a rectangular shape, and the first sleeve member 22 has a length extending in a direction transverse to that of the second sleeve member 42. With the different lengths and shapes of the first and second identification members 25, 26, a user can easily distinguish the first sleeve member 22 from the second sleeve member 42. Particularly, in this embodiment, the directions of the first and second sleeve members 22, 42 are transverse to each other, so that the user can determine the correct insert positions of the connector mechanisms 9. Thus, when the user can quickly and correctly identify the correct insert positions of the connector mechanisms 9, the wiring working time can be shortened, and the wiring work is easy.

In the current commonly used specification, each power cable 8 includes three power lines 81. When the connector mechanisms 9 are respectively inserted into the first and second sleeve members 22, 42, the power lines 81 of each power cable 8 are inserted through one of the connector mechanisms 9 into the corresponding blind holes 328 of the conductive members 322 (only one is shown in FIG. 12) located at one side of the base plate 31, and contact the screws 323 which extend into the blind holes 328. Since each two screws 323 are in electrical connection with the corresponding conductive member 322, each power line 81 of each power cable 8 contacting one of the screws 323 can be electrically connected to the power line 81 of the other power cable 8 contacting the other screw 323 through the corresponding conductive member 322. The mating operation of the power cables 8 can thus be completed.

Figure 13:
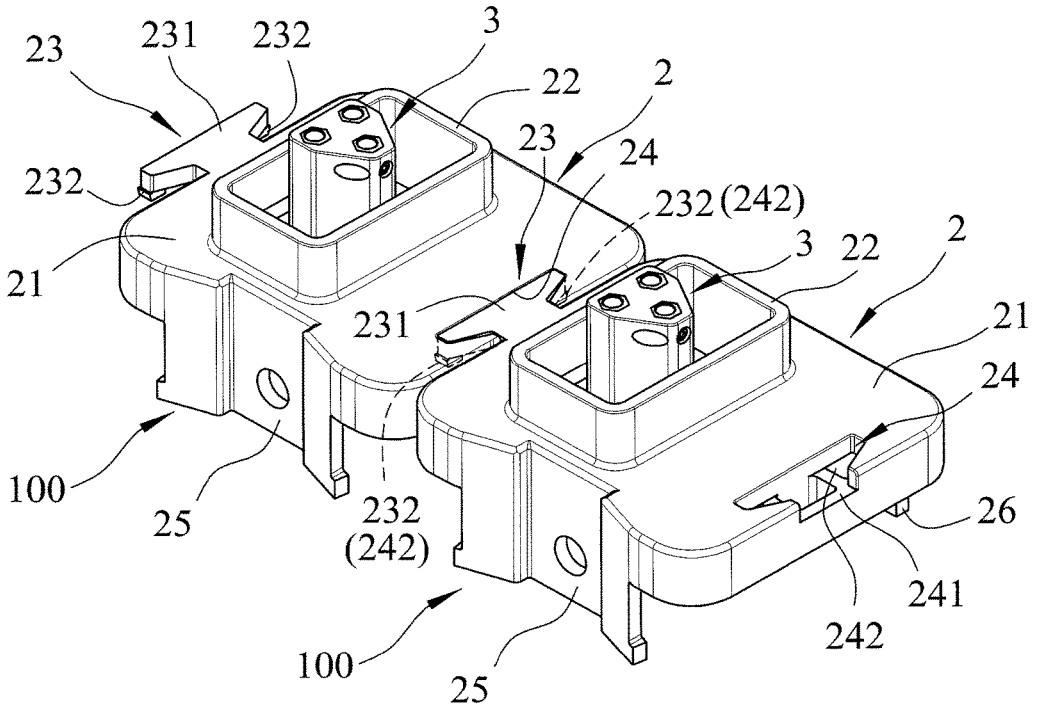
FIG. 13 is a perspective view, illustrating how two power adapters of the embodiment can be interconnected.

Referring to FIG. 13, to conduct a more complicated wiring work, a plurality of the power adapters 100 of the disclosure may be simultaneously used. The first connecting member 23 of one of the power adapters 100 can be connected to the second connecting member 24 of another one of the power adapters 100, thereby interconnecting two power adapters 100. When the multiple power adapters 100 of the disclosure are interconnected, apart from easy management due to relative concentration of the matching lines, and in comparison with the scattered power adapters 100, there is no need to move back and forth when conducting the wiring work, so that the difficulty of wiring can be reduced and the working efficiency can be enhanced. It should be noted herein that, when two power adapters 100 are interconnected through the first and second connecting members 23, 24, the hook portions 232 of the first connecting member 23 of one of the power adapters 100 are engaged to the engaging holes 242 of the second connecting member 24 of another power adapter 100, thereby ensuring that the two power adapters 100 are secured to each other and will not disengage from each other.

In sum, through the configuration of the first and second connecting members 23, 24 of the power adapter 100 of this disclosure, a plurality of the power adapters 100 can be combined and interconnected. Further, through the positions of the first and second sleeve members 22, 42 relative to the first and second identification members 25, 26, the insertion positions of the connector mechanisms 9 can be quickly and correctly identified, thereby achieving a foolproof effect and reducing the difficulty of the wiring work. Hence, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A power adapter configured to cooperate with two connector mechanisms and two power cables, each of the connector mechanisms including a tubular body for extension of a respective one of the power cables therethrough, and a plug connector connected to one end of the tubular body, said power adapter comprising:

a first body including a first main plate having two opposite first sides and a first opening between said first sides, a first sleeve member extending from a peripheral edge of said first opening in a direction away from said first main plate and defining a first space that is configured to receive the plug connector of one of the connector mechanisms, a first connecting member provided on one of said first sides of said first main plate, and a second connecting member provided on the other one of said first sides of said first main plate;

a connecting unit including a base plate abutting against said first main plate opposite to said first sleeve member; and a second body connected to and cooperating with said first body to clamp said base plate therebetween, said second body including a second main plate having a second opening, and a second sleeve member extending from a peripheral edge of said second opening in a direction away from said second main plate and defining a second space that is configured to receive the plug connector of another one of the connector mechanisms;

wherein said connecting unit further includes a connection module extending through said base plate such that one end of said connection module extends into said first space through said first opening for electrical connection with one of the power cables extending through the tubular body of the one of the connector mechanisms, and the other end of said connection module extends into said second space through said second opening for electrical connection with another one of the power cables extending through the tubular body of the another one of the connector mechanisms.

2. The power adapter as claimed in claim 1, wherein said connection module includes a support column extending along a longitudinal direction (N) and having three spaced-apart insertion slots extending along a length thereof, and three conductive members respectively inserted into said insertion slots for electrical conduction with the power cables, said support column having said ends of said connection module.

3. The power adapter as claimed in claim 2, wherein each of said conductive members extends along the longitudinal direction (N), and has a hexagonal cross section, each of said conductive members having two opposite end faces, two blind holes each extending inwardly a distance from a respective one of said end faces, and two threaded side holes extending inwardly and radially from one of six sides thereof and respectively communicating with said blind holes.

4. The power adapter as claimed in claim 3, wherein each of said conductive members has a longitudinal axis (C) parallel to the longitudinal direction (N), each of said blind holes being eccentric and being radially offset from the longitudinal axis (C) by a distance (D), said support column further having six through holes formed in one side thereof, three of said through holes being spaced apart from another three of said through holes along the length of said support column and being respectively aligned therewith, each two of said aligned through holes extending inwardly and radially from an outer surface of said one side of said support column and respectively communicating with said blind holes of a corresponding one of said conductive members through said threaded side holes, said connection module further including six screws each of which is inserted into a respective one of said through holes, threadedly engages one of said threaded side holes in one of said conductive members and extends diametrically into a corresponding one of said blind holes in said one of said conductive members.

5. The power adapter as claimed in claim 1, wherein said first main plate has opposite top and bottom surfaces, said first opening extending through said top and bottom surfaces, said first main plate further having two receiving grooves extending inwardly from said bottom surface and located at two opposite sides of said first opening, and a first annular protrusion protruding outwardly from said bottom surface and defining a retaining space, said second main plate being positioned in said retaining space.

6. The power adapter as claimed in claim 5, wherein said first main plate further has a second annular protrusion that protrudes from said bottom surface into said retaining space, that surrounds said receiving grooves and that defines a receiving space communicating with said receiving grooves, said first annular protrusion cooperating with said second annular protrusion to define an adhesive-receiving space therebetween that communicates with said retaining space, said first annular protrusion having a length measured from said bottom surface greater than that of said second annular protrusion, said second main plate being fixed to said first main plate through an adhesive introduced into said adhesive-receiving space, said base platebeing received in said receiving space of said second annular protrusion and said receiving grooves, and being clamped between said first main plate and said second main plate.

7. The power adapter as claimed in claim 6, wherein said second main plate has opposite top and bottom surfaces, and an annular flange extending transversely from a periphery of said top surface into said adhesive-receiving space, said second opening extending through said top and bottom surfaces of said second main plate.

8. The power adapter as claimed in claim 5, wherein said receiving grooves are not symmetrical in shape.

9. The power adapter as claimed in claim 1, wherein said first main plate further has two opposite second sides connected between said first sides, said first opening being surrounded by said first and second sides, said first body further including a first identification member connected to one of said second sides, and a second identification member connected to the other one of said second sides and having a shape different from that of said first identification member.

10. The power adapter as claimed in claim 1, wherein each of said first and second sleeve members has a rectangular shape, and said first sleeve member has a length extending in a direction transverse to that of said second sleeve member.

11. The power adapter as claimed in claim 1, wherein said first main plate has opposite top and bottom surfaces, said first opening extending through said top and bottom surfaces, said first connecting member including a main portion protruding outwardly from the one of said first sides of said first main plate, and two hook portions protruding transversely and respectively from two opposite sides of said main portion, said second connecting member including a receiving recess that extends from said top surface through the other one of said first sides of said first main plate, that has a shape matching that of said main portion, and that is configured to receive said main portion of said first connecting member of another said power adapter, and two spaced-apart engaging holes that are formed in said bottom surface in proximity to the other one of said first sides of said first main plate, that communicate with said receiving recess, and that are configured to respectively engage said hook portions of said first connecting member of the another said power adapter.

* * * * *